US005142461A

United States Patent [19]

Nugent

[11] Patent Number: 5,142,461

[45] Date of Patent: Aug. 25, 1992

[54] DECORATIVE LIGHT MOUNTING APPARATUS AND METHOD

[76] Inventor: Cynthia Nugent, R.R. 1, Box 179, Lockport, Ill. 60441

[21] Appl. No.: 655,325

[22] Filed: Feb. 13, 1991

Related U.S. Application Data

[63] Continuation of Ser. No. 431,762, Nov. 6, 1989, abandoned.

[51] Int. Cl.[5] ..... F21P 1/00

[52] U.S. Cl. ..... 362/252; 362/396; 362/806

[58] Field of Search ..... 362/249, 250, 252, 389, 362/396, 398, 806

[56] References Cited

U.S. PATENT DOCUMENTS

| | | | |
|---|---|---|---|
| 1,932,143 | 10/1933 | Piercy . | |
| 2,599,303 | 6/1952 | Ward . | |
| 3,504,169 | 3/1970 | Freeburger . | |
| 3,596,859 | 8/1971 | MacDonald . | |
| 4,491,902 | 1/1985 | Cangelosi . | |
| 4,852,832 | 8/1989 | Delaney | 248/314 X |
| 4,877,209 | 10/1989 | Gary | 248/314 X |
| 4,901,212 | 2/1990 | Prickett . | |
| 5,016,145 | 5/1991 | Singleton | 362/80.1 |

*Primary Examiner*—Allen M. Ostrager
*Attorney, Agent, or Firm*—Potthast & Ring

[57] ABSTRACT

A string of decorative lights (10) having a plurality of sockets (12) interconnected in a series by flexible lengths of power cord (14), the improvement is an apparatus for mounting the string of lights to a selected smooth surface (32) which comprises a socket mounting assembly (16) for each of selected ones of a plurality of sockets (12) which includes a socket mounting member (18) which comprises a socket engaging part (20) and a releasible fastener section (21) and a means for relatively attaching (22) socket engaging part (20) to socket (12). Further, this invention includes a surface mounting assembly (24) for each of the selected ones of the plurality of sockets (12) which includes a surface mount (26) having a mating fastener part (28) for relatively releasible connection with fastener section (21) of the socket mounting assembly (16) and a means for noninvasively attaching (30) the surface attachment part (28) to the selected smooth surface (32) without penetrating it.

19 Claims, 2 Drawing Sheets

Fig. 3
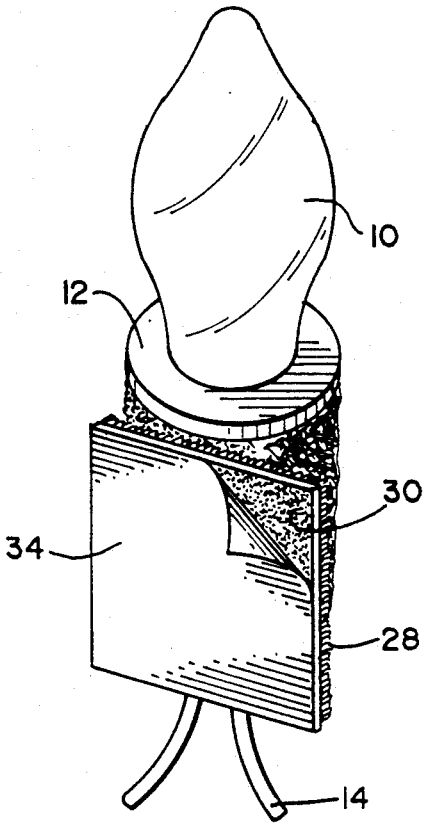
Fig. 1
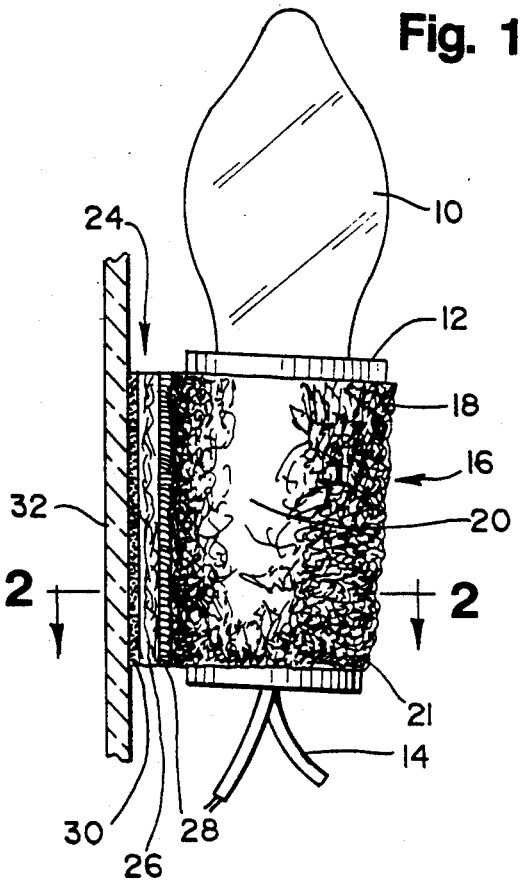
Fig. 2
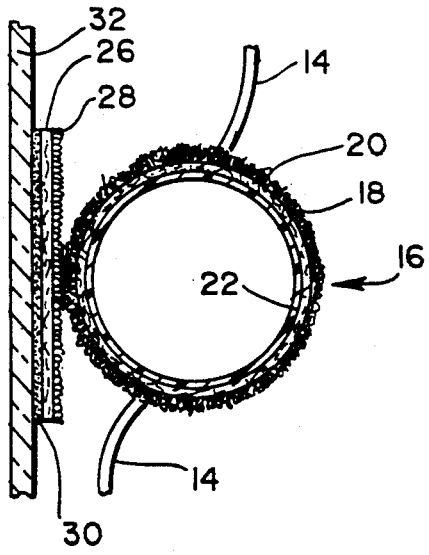
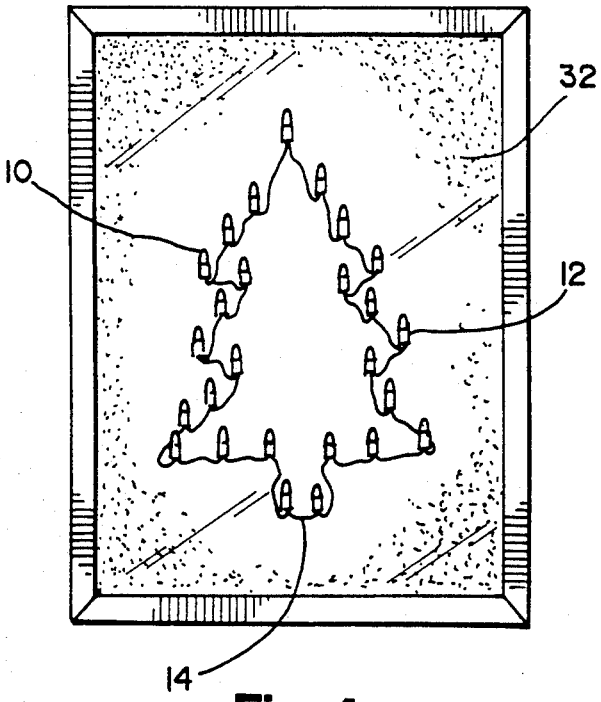
Fig. 4

Fig. 5
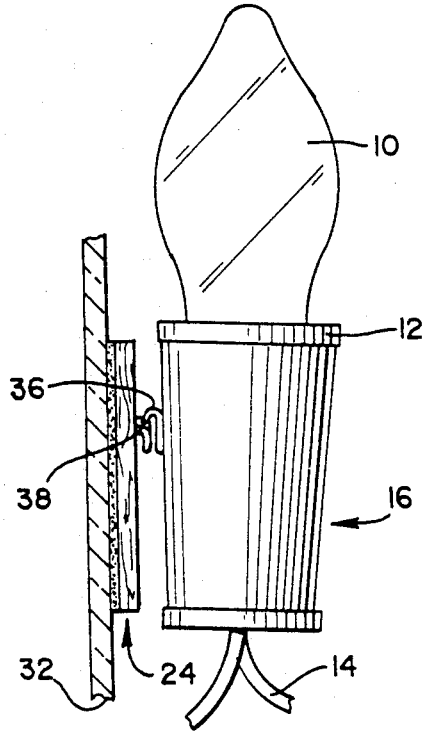
Fig. 6
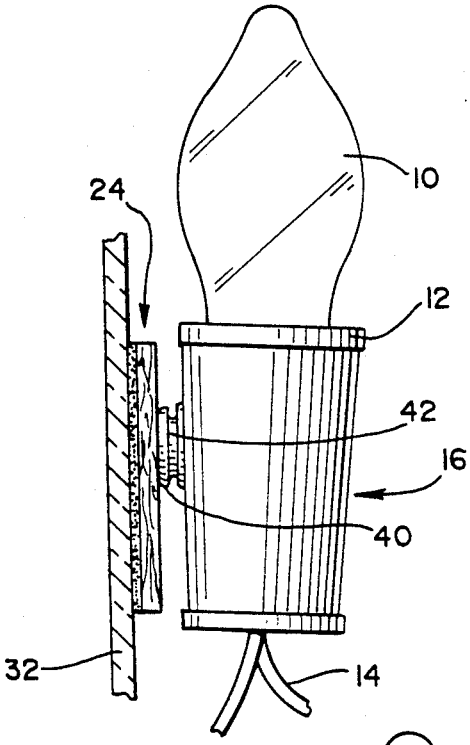
Fig. 7
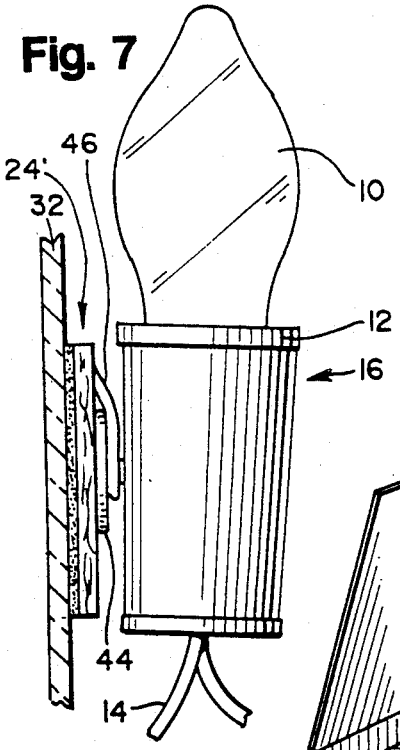
Fig. 9
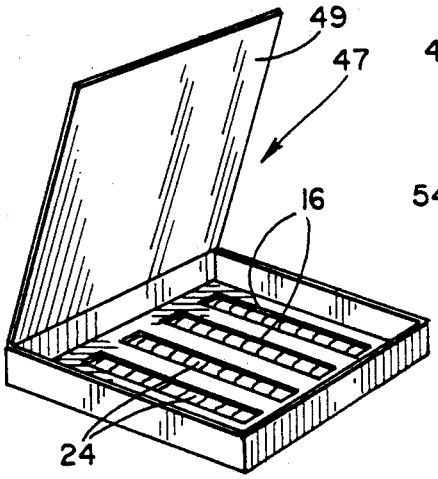
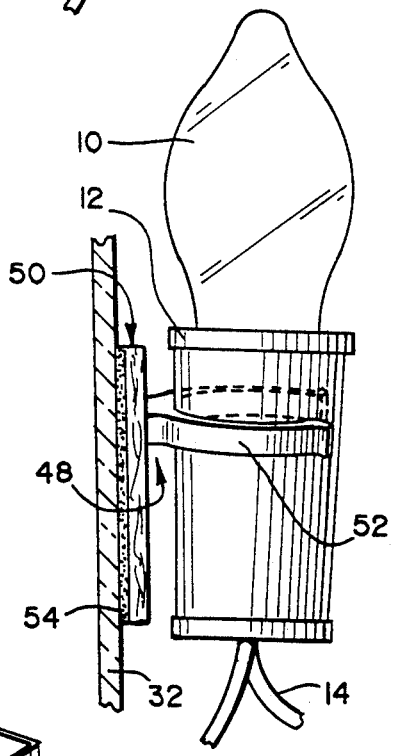
Fig. 8

DECORATIVE LIGHT MOUNTING APPARATUS AND METHOD

This application is a continuation of U.S. patent application Ser. No. 07/431,762, filed Nov. 6, 1989, now abandoned.

BACKGROUND OF THE INVENTION

1. Field of the Invention

The present invention relates to a mounting apparatus and method to hang a string of decorative lights, and more particularly pertains to a new mounting assembly and method to hang strings of Christmas lights in various arrangements to the surface of a smooth surface without penetrating that surface.

2. Description of the Prior Art

The use of systems to support strings of Christmas lights is well known in the prior art. There are various types of apparatus used to support a string of Christmas lights. The following are examples of these devices.

U.S. Pat. No. 4,774,646, issued to L'Heureaux on Sep. 27, 1988, reveals a rigid modular system which supports a string of lights but does not permit the versatility of placing each light in various locations with discrete mounting assemblies. This system also does not teach releasibly, noninvasively securing a string of lights to a smooth surface without penetrating that surface.

U.S. Pat. No. 4,128,863 issued to Premetz on Dec. 5, 1978, discloses a string of decorative lights which are hung to a facer board permitting the lights to be placed in view when desired and removed from view when not. This system does not teach to releasibly, noninvasively secure lights to a smooth surface without penetrating that surface or secure lights in various locations with discrete mounting assemblies.

U.S. Pat. No. 2,172,757 issued Sep. 12, 1939, shows a bracket having multiple sockets to hold decorative lights in which the bracket can be secured to a smooth surface by means of a suction cup. This bracket is rigid and does not teach to releasibly secure individual lights of a string of decorative lights in various locations with discrete mounting assemblies.

U.S. Pat. No. 3,275,818, issued to Campbell on Sep. 27, 1966, teaches a modular adjustable frame having straight segments to support and display a string of lights. This system does not teach to releasibly secure lights in various locations with discrete mounting assemblies.

U.S. Pat. No. 4,244,014 issued to VanEss on Jan. 6, 1981, reveals a system for mounting decorative lights by trapping the light socket between a flexible tape and bracket on two flexible pieces of tape. This does not teach to locate the lights in various locations with discrete mounting assemblies to releasibly secure the lights to a smooth surface.

U.S. Pat. No. 4,795,121 issued to Comito on Jan. 3, 1989, shows a modular system for supporting a string of decorative lights. This modular system does not teach to releasibly secure the lights in various locations with discrete mounting assemblies or to releasibly, noninvasively secure the lights to a smooth surface without penetrating the surface.

U.S. Pat. No. 4,769,749 issued to Felski on Sep. 6, 1988, discloses a modular system to support a string of decorative lights which can be bendable but it does not teach to releasibly, noninvasively support the lights to a smooth surface without penetrating the surface nor provide for locating the lights in various locations with discrete mounting assemblies.

U.S. Pat. No. 4,761,720 issued to Solow on Aug. 2, 1988, shows a thin and flexible tape which contains imbedded lights. This device does not teach to locate the lights in various locations with discrete mounting assemblies.

U.S. Pat. No. 4,714,219 issued to Mayse on Dec. 22, 1987, reveals a set of brackets mounted into a surface which carry a string of decorative lights. This does not teach locating the lights in various locations with discrete mounting assemblies or to releasibly, noninvasively mount the lights to a smooth surface without penetrating the surface.

U.S. Pat. No. 4,679,126 issued to Van Sickler on Jul. 7, 1987, shows a decorative light socket which has a clip to mount the lights of a string of lights to a branch. This device does not teach to releasibly, noninvasively mounting the lights to a smooth surface without penetrating the surface or locating them in various locations with discrete mounting assemblies.

U.S. Pat. No. 4,335,422 issued to Van Ess on Jun. 15, 1982, discloses light mounting tapes which are elastic and can be stretched to trap the lights of a string of decorative lights. This device does not teach releasibly and noninvasively mounting the lights to a smooth surface without penetrating the surface or to locate the lights in various locations with discrete mounting assemblies.

SUMMARY OF THE INVENTION

Accordingly, it is the principal object of the present invention to provide an apparatus and method to releasibly secure selected sockets of lights of a string of decorative lights to a smooth surface noninvasively and to locate selected lights of the same string of lights to various locations with discrete mounting assemblies.

A first embodiment of the invention is to provide a socket mounting assembly for each of a selected ones of a plurality of sockets in a string of decorative lights and a corresponding surface mounting assembly. The socket mounting assembly has a support socket engaging part and a releasible fastener section. The surface mounting assembly has a surface mount with a mating fastener part for relatively releasible connection with the fastener of the socket mounting assembly and surface attachment part. The surface mounting assembly also has a means for attaching the surface attachment part to a smooth surface. This permits releasibly securing selected ones of light sockets of a string of decorative lights to a smooth surface, noninvasively, and locating the selected sockets in various locations with the discrete mounting assemblies. As a result the use of this invention can easily create various designs with a string of decorative lights on a smooth surface such as glass; to a smooth surface that is difficult to penetrate; or to a smooth surface you wish not to deface.

This invention further provides a method to accomplish the results stated in the above embodiment by fixedly securing a socket mounting member with a releasible fastener section directly to selected ones of the plurality of sockets. Also, fixedly attaching a surface mount with a releasible mating fastener part directly to a selected smooth surface and releasibly connecting together the fastener section and the mating fastener part.

A second embodiment of this invention which will accomplish the same results is a mounting kit which provides a plurality of socket mounting assemblies for attachment to a plurality of sockets each having a socket mounting member with one complement of miniature hook/loop type connector and a means for adhering the socket mounting member to a socket. It further provides a corresponding plurality of surface mounting assemblies each having a miniature mating hook/loop type connector and means for adhering the mating connector to a selected surface.

A third embodiment of this invention provides a surface mounting assembly for each of selected ones of the plurality of sockets of a string of decorative lights having a surface mount with a fastener part for relatively releasible connection with the selected sockets and a surface attachment part. Finally, it provides a means for attaching the surface attachment part to a smooth surface noninvasively.

This invention further provides a method to accomplish the results of the above embodiment by fixedly securing a surface mounting assembly to a smooth surface noninvasively and said surface mounting assembly having a fastener part for releasible connecting with selected sockets of a string of decorative lights.

BRIEF DESCRIPTION OF THE DRAWINGS

FIG. 1 is a perspective view of a preferred embodiment of the present invention which mounts a selected socket of a string of lights to a smooth surface;

FIG. 2 is a sectional view taken on lines II—II of FIG. 1;

FIG. 3 is a perspective view of the preferred embodiment showing a partial pull away of a protective covering over the attaching means of the surface attachment part;

FIG. 4 is a plan view of a window with a string of decorative lights mounted to it with the present invention;

FIG. 5 is a perspective view of another embodiment of the present invention which mounts a selected socket of a string of decorative lights to a smooth surface in which the releasible fastener section and mating fastener part are a hook and loop;

FIG. 6 is a perspective view of an embodiment of the present invention as shown in FIG. 5 in which the releasible fastener section and mating fastener part are a button and a loop;

FIG. 7 is a perspective view of another embodiment of the invention as shown in FIGS. 5 in which the releasible fastener section and mating fastener part are mating arrangements of flexible male and female snap fit members;

FIG. 8 is a perspective view of an embodiment of the invention showing a fastener part in releasible connection with a selected socket; and FIG. 9 is a perspective view of a mounting kit for mounting a string of decorative lights.

DETAILED DESCRIPTION

Referring now to the drawing, a string of decorative lights interconnected by flexible lengths of power cord is shown in combination with the preferred embodiment of the invention for mounting of the string of decorative lights to a selected smooth surface is seen in FIGS. 1–4. As can be seen in FIG. 1, a typical decorative light 10 is secured to a light socket 12. Light sockets 12 are interconnected to one another by flexible electrical cord 14. Cord 14 usually connects a string of sockets 12, as seen in FIG. 4.

The preferred embodiment comprises first a socket mounting assembly 16 as shown in FIG. 1. Mounting assembly 16 comprises a socket mounting member, or base, 18 and a releasible fastener section 20. Socket mounting member 18 comprises a socket engaging part 20 which comprises a flexible material that can be folded easily into an arcuate shape that conforms to and receives the outer surface of a typical socket 12 and holds a releasible fastener section 21. This releasible fastener section 21 preferably comprises a pile type fastener of either a plurality of miniature flexible hooks/loops. This entire mounting assembly 16 is secured to socket 12 by an attaching means or contact adhesive 22 as seen in FIG. 2. This contact adhesive is usually active in a nonmoistened state.

Secondly, the preferred embodiment comprises a surface mounting assembly 24, as seen in FIG. 1. Assembly 24 has a surface mount or base 26 and a mating fastener part 28 attached thereto. Mating fastener part 28 is a pile type fastener of either a plurality of miniature flexible hooks/loops. Depending on what releasible fastener section 20 is comprised of, hooks or loops, mating fastener 28 will be the other type of pile. This arrangement permits ease in releasibly attaching mounting assembly 16 to surface mounting assembly 24. Surface mounting assembly 24 has an attaching means 30 which is disposed on its backside of mount or base 26 to noninvasively secure mounting assembly 24 to a smooth surface such as window 32 without penetrating such surface. Attaching means 30 is also preferably a contact adhesive which is active in a nonmoistened state. As a result, a protective cover means 34, as shown in FIG. 3, is used to shield the adhesive until ready for use, this protective cover will be also used to protect contact adhesive 22 of mounting assembly 16. Surface mounting assembly 24 and mounting assembly 16 are of a material of the type commonly known to be VELCRO BRAND STICKY BACK, a federally registered trademarked product, of Velcro USA, Inc., and the like.

Socket mounting assembly 16 could also be attached to socket 12 by being integrally formed with socket 12.

Surface mounting assembly 24 can be composed of a translucent and colorless material. With this composition, surface mounting assembly 24 would be less noticeable to an observer by not substantially contrasting with the color of the surface to which it is attached.

This invention permits one to place individual lights, of a string of lights, in discrete desired positions relative to each other. As can be seen in FIG. 4, one may easily outline a desired design with a string of lights on a window surface or any relatively smooth surface by releasibly mounting sockets of the string to the window surface by placing the surface mounting assembly in desired positions and releasibly connecting the mounting assembly thereto. This invention permits much versatility in mounting all, most or some of the lights 10 of a string of lights to a smooth surface. Because of the construction of the surface mounting assembly 24, a smooth surface will not be invaded, or penetrated, to thereby permit decorating on glass and other surfaces you wish not to deface. Further, versatility is provided by the preferred use of contact adhesive, which are well known, such as are used in VELCRO BRAND STICKY BACK, federally registered trademark product of Velcro USA, Inc. These adhesives will actuate in nonmoistened conditions and work in a wide range of temperatures, particularly 200 degrees F. down to −70 degrees F., thus permitting use indoors as well as outdoors.

Other embodiments of the present invention can be seen in FIGS. 5 through 7. The only changes to these embodiments involve the construction of releasible fastener section 21 and mating fastener part 28, of FIGS. 1-3. As can be seen in the embodiment of FIG. 5, the releasible fastener section is a hook 36 and the mating fastener part is a mating loop 38. Otherwise, the hook 36 and mating hoop 38 can be used as the mating fastener part and the releasible fastener section 21, respectively. As can be seen in FIG. 6 another embodiment has the elements of the releasible fastener section 21 and mating fastener 28 of FIGS. 1-3 either being an annular flexible female mating member 40 and the other being a flexible male mating member 42, or vice versa. As can be seen in FIG. 7, another embodiment has the elements of releasible fastener section 21 and mating fastener section 28 being a button 44 and the other a corresponding mating loop 46, or vice versa.

Another aspect of this invention is a method for releasibly mounting to a selected smooth surface a string of decorative lights having a plurality of sockets interconnected in a series by flexible lengths of power cord. This method incorporates fixedly securing a socket mounting member 18 having a releasible fastener section 21 directly to selected ones of a plurality of sockets 12. Then, fixedly attaching surface mount 26 having a releasible mating fastener 28 directly to a selected smooth surface noninvasively. Then, releasibly connecting together releasible fastener section 21 to mating fastener 28.

In this method, the step of releasibly connecting is performed after the step of fixedly attaching. However, the step of releasibly connecting also can be performed before the step of fixedly attaching.

Further in this method the step of fixedly attaching includes the step of adhering surface mount 26 to a selected surface. This may also include the step of removing a protective cover 34 from an adhesive 30 on the surface mount assembly 24.

Finally, the step of releasibly connecting includes the step of engaging a cluster of miniature flexible hooks on one of the socket mounting member 18 and the surface mounting member 26 with a cluster of miniature flexible loops on the other of the socket mounting member 18 and the surface mounting member 26.

This invention includes a mounting kit 48, as seen in FIG. 9, for mounting a string of decorative lights having a plurality of sockets interconnected in a series by flexible power cords in which there are a plurality of socket mounting assemblies 16 for attachment to a plurality of sockets 12. Mounting assemblies 16 include a socket mounting member 18 with one complement of a hook/loop type connector, as described earlier, and a means of adhering the socket mounting member 18 to a socket 12 or contact adhesive. Further, this mounting kit would include a corresponding plurality of surface mounting assemblies 24 in which each would have a miniature mating hook/loop type connector 28 and a means for adhering 30 or contact adhesive of the mating connector to a selected smooth surface noninvasively.

Usually kit 48 will contain strips of scored material of hook/loop type connector material. Also, there will be the same number of hooked material as there are looped material, thereby permitting the same number of mounting assemblies 16 as there would be surface mounting assemblies 26. Even though the dimensions of each of these assemblies may vary, the commercially desired size will be approximately $\frac{5}{8}'' \times \frac{1}{2}''$.

The socket mounting member 18 of this kit should be made of a flexible material and sufficiently elongate to wrap at least partially around socket 12, FIGS. 1-3.

The adhering means 30 of the kit includes a layer of adhesive having a removable protective cover 34 overlying the adhesive as can be seen for example in FIG. 3.

Finally, the surface mounting assemblies 24 can be made of a substantially translucent material which will reduce the appearance of it on the smooth surface.

All the elements of the kit are contained in a suitable box 49 or other container along with instructions teaching the above method.

This invention also provides, as seen in FIG. 8, a surface mounting assembly 48 for each of selected ones of a plurality of sockets 12 including a surface mount 50 having a fastener part 52 which can provide releasible connection with selected ones of the plurality of sockets 12 and the surface mount 50. It also has a means for attaching surface mount 50 to a selected smooth surface 32, noninvasively.

Fastener part 52 can be constructed in a U-shaped elastic clip which can releasibly grip socket 12. This clip can be made of a semi-flexible plastic and can be integrally connected to surface mount 50.

Surface mount 50 is attached to smooth surface 32 with a contact adhesive 54. This adhesive 54, which has been described earlier as contact adhesive 22, is activated in a nonmoistened state and has a protective covering 34, FIG. 3, which will prevent the adhesive from adhering to anything other than the smooth surface 32.

Once again, mounting assembly 48 can be made of a substantially translucent and colorless material which will make the assembly blend into the appearance of the smooth surface 32.

Finally the invention includes the method having the steps of securing surface mounting assembly 48 having a fastener part 52 for releasible connection with selected sockets 12, to a smooth surface, noninvasively. The next step is releasibly connecting selected sockets 12 to fastener part 52. This method can also have these two steps reversed. Furthermore, the step of releasibly connecting includes the step of engaging one of the selected sockets with a U-shaped elastic clip.

With respect to the above description then, it is to be realized that the optimum dimensional relationships for the parts of the invention, to include variations in size, materials, shape, form function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In a string of decorative lights having a plurality of sockets interconnected in a series by flexible lengths of power cord, the improvement being an apparatus for mounting of the strings of lights to a substantially planar selected smooth surface, comprising:

a socket mounting assembly for each of selected ones of the plurality of sockets including a socket mounting member with a socket engaging part having a flexible body to fold around a portion of a socket and a releasible fastener section, and means for releasibly securing the socket engaging part of the socket; and a corresponding surface mounting assembly for each of the selected ones of the plurality of sockets including a surface mount with a mating fastener part for relatively releasible connection with the fastener section of the socket mounting assembly and a planar segment surface attachment part, and adhesive disposed on a side of the planar segment attachment part to attach said side of said attachment part to the substantially planar selected smooth surface without penetrating such smooth surface.

2. The string of decorative lights of claim 1 in which all of said sockets are selected and have socket mounting assemblies attached thereto.

3. The string of decorative lights of claim 1 in which said means for releasibly attaching the socket engaging part to the socket includes an adhesive.

4. The string of decorative lights of claim 1 in which said socket mounting member forms an arcuate surface within which the socket is received.

5. The string of decorative lights of claim 1 in which said releasible fastener section of each selected socket is releasibly attached to a mating fastener part.

6. The string of decorative lights of claim 1 in which the releasible fastener section and said mating fastener part are mating arrangements of miniature, flexible, interconnecting hooks and loops.

7. The string of decorative lights of claim 1 in which the releasible fastener section and said mating fastener part are mating arrangements of a hook and loop.

8. The string of decorative lights of claim 1 in which said adhesive is active in a nonmoistened state and the surface mounting assembly includes means for protectively covering the adhesive from adhering to anything other than the selected smooth surface.

9. The string of decorative lights of claim 1 in which said surface mount is substantially translucent and colorless.

10. A method of releasibly mounting to a substantially planar selected smooth surface a string of decorative lights having a plurality of sockets interconnected in a series by flexible lengths of power cord, comprising the steps of:

fixedly securing a socket mounting member having a flexible body to fold around a portion of a socket with a releasible fastener section directly to selected ones of the plurality of sockets;

fixedly attaching corresponding planar segment surface mounts having an adhesive disposed on one side and a releasible mating fastener part on the other directly noninvasively to the substantially planar selected smooth surface with said adhesive;

releasibly connecting together the fastener section and the mating fastener part.

11. The releasible light mounting method of claim 10 in which said step of releasibly connecting is performed after the step of fixedly attaching.

12. The releasible light mounting method of claim 10 in which said step of releasibly connecting is performed before said step of fixedly attaching.

13. The releasible light mounting method of claim 10 in which said step of fixedly attaching includes the step of adhering the surface mount to the selected surface.

14. The releasible light mounting method of claim 13 in which said step of fixedly attaching includes the step of removing a protective cover from an adhesive on the surface mount.

15. The releasible light mounting method of claim 10 in which said step of releasibly connecting includes the step of engaging a cluster of miniature flexible hooks on one of the socket mounting member and the surface mounting member with a cluster of miniature flexible loops on the other of the socket mounting member and the surface mounting member.

16. A mounting kit for mounting a string of decorative lights having a plurality of sockets interconnected in a series by flexible power cords, comprising:

a plurality of socket mounting assemblies for attachment to a plurality of sockets each having a socket mounting member with one complement of a hook/loop type connector, and means for adhering the socket mounting member to a socket; and a corresponding plurality of surface mounting assemblies having a planar segment, each having a miniature mating hook/loop type connector attached to one side of said planar segment of the assemblies, and adhesive disposed on the other side of the planar segment for noninvasively adhering the mating connector to a substantially planar selected surface without penetrating said surface.

17. The decorative light mounting kit of claim 16 in which said socket mounting member is flexible and sufficiently elongate to wrap at least partially around the socket.

18. The decorative light mounting kit of claim 16 in which said adhering means includes a layer of adhesive and a removable protective cover overlying the adhesive.

19. The decorative light mounting kit of claim 16 in which said surface mounting assemblies are substantially translucent.

* * * * *